US009365780B2

(12) United States Patent
Basfar et al.

(10) Patent No.: US 9,365,780 B2
(45) Date of Patent: Jun. 14, 2016

(54) COLD PROCESS FOR REMOVAL OF SULFUR IN STRAIGHT RUN DIESEL BY OZONE AND TERT-BUTYL HYDROPEROXIDE

(71) Applicant: King Abdulaziz City for Science and Technology, Riyadh (SA)

(72) Inventors: Ahmed Ali Basfar, Riyadh (SA); Yasser S. Soliman, Cairo (EG)

(73) Assignee: KING ABDULAZIZ CITY FOR SCIENCE AND TECHNOLOGY, Riyadh (SA)

( * ) Notice: Subject to any disclaimer, the term of this patent is extended or adjusted under 35 U.S.C. 154(b) by 215 days.

(21) Appl. No.: 14/183,821

(22) Filed: Feb. 19, 2014

(65) Prior Publication Data

US 2015/0232765 A1 Aug. 20, 2015

(51) Int. Cl.

| | |
|---|---|
| ***C10G 27/14*** | (2006.01) |
| ***C10G 27/04*** | (2006.01) |
| ***C10G 53/14*** | (2006.01) |
| *C10G 53/02* | (2006.01) |

(52) U.S. Cl.

CPC ..... *C10G 27/14* (2013.01); *C10G 27/04* (2013.01); *C10G 53/14* (2013.01); *C10G 2300/202* (2013.01)

(58) Field of Classification Search

CPC ..... C10G 27/04; C10G 27/14; C10G 53/02; C10G 53/14

See application file for complete search history.

(56) References Cited

U.S. PATENT DOCUMENTS

| | | | | |
|---|---|---|---|---|
| 6,160,193 | A * | 12/2000 | Gore | C10G 27/04 208/208 R |
| 6,500,219 | B1 * | 12/2002 | Gunnerman | C10G 35/04 208/208 R |
| 7,867,376 | B2 * | 1/2011 | Browne | C10G 27/04 208/3 |
| 8,066,851 | B2 * | 11/2011 | Kapila | B09C 1/06 196/98 |
| 2005/0247599 | A1 * | 11/2005 | Browne | C10G 27/04 208/3 |
| 2008/0308463 | A1 * | 12/2008 | Keckler | B01J 21/063 208/249 |

(Continued)

FOREIGN PATENT DOCUMENTS

EP 0236021 A2 2/1987

OTHER PUBLICATIONS

Attar, A. et al. (1978). Industrial and Engineering Chemistry Product Research and Development, 17(2), 102-109.*

(Continued)

*Primary Examiner* — Brian McCaig

(74) *Attorney, Agent, or Firm* — Andrew M. Calderon; Roberts Mlotkowski Safran & Cole, P.C.

(57) ABSTRACT

A method and process to remove sulfur compounds from a real fuel product of straight-run diesel (SRD) by the action of ozone bubbling and tert-butyl hydroperoxide (t-BUOOH) under normal laboratory conditions is disclosed. Slight desulfurization is taken place after ozone bubbling process which may be assigned to a removal of sulfur compounds in a gaseous form ($SO_x$). Most of the organically bound sulfur and/or elemental sulfur and hydrogen sulfide still exist in the ozonized samples. Sulfur removal from SRD samples was achieved by combining ozone bubbling with extraction by using different solvents to remove the oxidized sulfur compound (polar) from ozonized samples. This method provides a considerable level of total sulfur reduction where the reduction of sulfur reaches 93%.

46 Claims, 4 Drawing Sheets

(56) References Cited

U.S. PATENT DOCUMENTS

| | | | | |
|---|---|---|---|---|
| 2011/0203972 | A1 | 8/2011 | Gargano et al. | |
| 2012/0074040 | A1 | 3/2012 | Koseoglu et al. | |
| 2012/0138449 | A1* | 6/2012 | Basfar | C10G 21/12 204/158.21 |
| 2013/0164798 | A1* | 6/2013 | Vanhercke | C10L 1/04 435/134 |

OTHER PUBLICATIONS

Shiraishi, et al., "A Desulfurization Process for Light Oil Based . . . Subsequent Adsorption of N-Tosylsulfimides", Ind. Eng. Chem. Res. 2002, 41, pp. 4376-4382.

Jiang, et al., "Oxidative Desulfurization of Fuel Oils", Chinese Journal of Catalysis, V. 32, Issue 5, May 2011, abstract.

She, et al., "Study on Oxidation-Extraction Desulfurization of Straight-Run . . . Transfer Catalysis", Petroleum Processing and Petrochemicals 39, Aug. 2008, abstract.

Tang, et al., "The Pilot Test of Catalyzing-Oxidation Desulphurization Technique of the Straight-Run Diesel", 2007, abstract.

Breysse, et al., "Deep desulfurization: reactions, catalysts and technological challenges", Catalysis Today 84, 2003, pp. 129-138.

Hao, et al., "An Improved Desulfurization Process . . . Gas Oil Feedstocks", Petroleum Science and Technology, 2005, pp. 991-999.

Wan, et al., "Enhance efficiency of tetraoctylammonium fluoride . . . oxidative desulfurization (UAOD) process", Applied Catalysis A: General 319, 2007, pp. 237-245.

Campos-Martin, et al., "Oxidative Processes of Desulfurization of Liquid Fuels", Instituto de Catálisis y Petroleoquímica, 2010, 33 pages.

Shakirullah, et al., "Study on the Role of Metal Oxides in Desulphurization of Some Petroleum Fractions", Journal of the Chinese Chemical Society, 2009, pp. 107-114.

Chan, "Superoxide Radical and UV Irradiation in Ultrasound Assisted . . . Alternative for Greener Fuels", University of Southern California, May 2010, 267 pages.

Chan, et al., "Superoxides: Alternative Oxidants for the Oxidative Desulfurization Process", Energy & Fuels, 2008, pp. 3326-3328.

* cited by examiner

COLD PROCESS FOR REMOVAL OF SULFUR IN STRAIGHT RUN DIESEL BY OZONE AND TERT-BUTYL HYDROPEROXIDE

FIELD OF THE INVENTION

The present disclosure relates to a process to remove sulfur from a petroleum real product of straight-run diesel by a combination of ozone and tert-butyl hydroperoxide.

BACKGROUND

The sulfur removal from light oil is extremely important in the petroleum-processing industry. Several processes have been proposed in the past to deal with the problem of removing these compounds from light oil. The most important and common industrial process is that of treating the fuel under high temperatures and high pressures with hydrogen. This process is called hydrodesulfurization (HDS) and has received extensive attention since its discovery in 1930's.

The sulfur compounds contained in petroleum fuels include aliphatic molecules such as sulfides, disulfides, and mercaptans as well as aromatic molecules such as thiophene, benzothiophene, dibenzothiophene, and alkyl derivatives such as 4,6-dimethyl-dibenzothiophene. Where, the conventional HDS technology can desulfurize aliphatic and cyclic sulfur-containing organic compounds on an industrial scale, as in most refineries in the world. Meanwhile, the aromatic dibenzothiophene (DBT) and especially 4,6-alkyl-substituted DBTs are difficult to convert to $H_2S$ due to the sterically hindered nature of these compounds on the catalyst surface (Shiraishi Y. et al. 2002). Additionally, from environmental and economic viewpoints, it is desirable to develop a more energy-efficient desulfurization process for production of virtually sulfur-free fuel due to the requirements of high temperature, high $H_2$ pressure and hence a larger reactor as well as an active catalyst.

Oxidative desulfurization (ODS) has been considered as a further new promising technology for deep desulfurization of light oil because it can be carried out under mild conditions, such as relatively low temperature, pressure and cost of operation when it is compared with HDS (Breysse et al., 2003). This desulfurization process includes two stages: (i) oxidation in a first step; and (ii) liquid extraction at the end. It is evident that the greatest advantages of the ODS process are low reaction temperature and pressure, and that expensive hydrogen is not used in the process. Another feature of ODS is that the refractory S-containing compounds in ODS are easily converted by oxidation.

Sulfur-containing compounds are oxidized using a selective oxidant to form compounds that can be preferentially extracted from light oil due to their increased relative polarity. Such oxidants include peroxy organic acids, hydroperoxides, nitrogen oxides, peroxy salts and ozone, etc. and such oxidants can donate oxygen atoms to the sulfur in mercaptans (thiols), sulfides, disulfides and thiophenes to form sulfoxides or sulfones (Campos-Martin, et al., 2010). Several oxidation systems have been studied, such as $H_2O_2$/heteropolyanion (phase transfer catalyst) (Wan and Yen, 2007), $H_2O_2$/formic acid system (Hao, et al., 2005).

Superoxides, for instance, potassium superoxide, have been demonstrated as alternative oxidants for the ODS process. For model compounds of benzothiophene, dibenzothiophene, and a number of selected diesel oil samples, sulfur removal greater than 90% and as high as 99% was accomplished (Chan et al., 2008). The results for using this solid potassium superoxide are comparable to or better than the results with liquid hydrogen peroxide for the ultrasound-assisted oxidative desulfurization (UAOD) or ODS process. Super oxide anion, $O_2^-$. is a free radical having one unpaired electron. Many types of superoxides are stable at dry ambient conditions even in high purity. Upon contact with water, it dissociates forming $O_2$ and $H_2O_2$. Therefore, these materials can provide high active oxygen ratio as in the case of potassium superoxide which has an active oxygen ratio of 45 wt. % (Chan, 2010). In addition, potassium permanganate and sodium superoxide are used efficiently under the effect of UV-irradiation in ultrasound assisted system for inducing oxidative desulfurization of some model sulfur compounds. $KMNO_4$ and $NaO_2$ induced removal of sulfur compounds (BT and DBT) with a maximum of >98%. When applying potassium superoxide to marine gas oil, jet propellant 8 and sour diesel in the presence of some of the ionic liquids and under the effect of temperature, the desulfurization brought a maximum of about 98%, 99% and 95%, respectively.

Using some special additives like ethylene diamine tetraacetic acid (EDTA), magnesium silicate and sodium silicate could enhance the desulfurization process of cooker gas oil (CGO) under the effect of hydrogen peroxide/formic acid system. These additives were selected to catalyze hydrogen peroxide decomposition, thus improving oxidation efficiency and extraction process more effectively. In case of using EDTA with $H_2O_2$/formic acid system, the desulfurization of CGO reached 90% (Hao, et al., 2005). In addition, metal oxides are found to be more reactive towards the compounds of sulfur, especially thioles compounds. Several of metal oxides like $MnO_2$, $PbO_2$, $Al_2O_3$, $MgO_2$, $ZnO_2$ and silica have been investigated in desulfurization of Jhal Magsi crude oil and its distillation fractions (kerosene and diesel). The results indicate that $PbO_2$ and $MnO_2$ caused a more significant effect of sulfur depletion in all three samples (Jhal Magsi crude oil, kerosene and diesel) than in the case of other oxides. According to these studies, lead oxide and manganese oxide achieved a maximum desulfurization in crude oil of about 55.35% and 45.18%, respectively in the case of reaction time 1 hour. In the case of kerosene and diesel, lead oxide achieved a maximum sulfur removal of about 49.05% and 54.54%, respectively, during the reaction time of 1 hour. Increasing the reaction time between magnesium oxide and Jhal Magsi crude oils and its distillate fractions (kerosene and diesel) enhances the desulfurization process (Shakirullah, et al., 2009).

SUMMARY

Embodiments of the present invention relate to a process for removing sulfur compounds from a petroleum real product of straight-run diesel (≅1.41 mass %) by using ozone ($O_3$) as oxidizer. The process of AOPs, which involve oxidation of sulfur species by ozone bubbling at room temperature, provides novel process to remove and/or decrease the total sulfur content and to improve quality and environmental safety.

In one or more embodiments, sulfur reduction levels are measured as a result of introducing ozone into straight-run diesel at room temperature.

In some embodiments, kinematic viscosity at 40° C. is measured as a result of introducing ozone into straight-run diesel at room temperature.

In another embodiment, sulfur removal from straight-run diesel was achieved by combining ozone bubbling with other physical/chemical processes (i.e. L/L extraction and oxidation) which achieved considerable levels of total sulfur reduction in the investigated products.

According to some embodiments, ozone was bubbled into straight-run diesel and extracted by polar solvents and the levels of total sulfur contents and kinematic viscosity at 40° C. are measured.

According to further embodiments, tert-butyl hydroperoxide (t-BuOOH) was used for oxidizing sulfur compounds in SRD and followed by extraction process to remove the oxidized sulfur compounds.

In embodiments, the achieved sulfur removal from extracted samples was finally investigated.

In some embodiments, kinematic viscosity at 40° C. is measured for the un-extracted and extracted samples.

DETAILED DESCRIPTION

Figure 1:
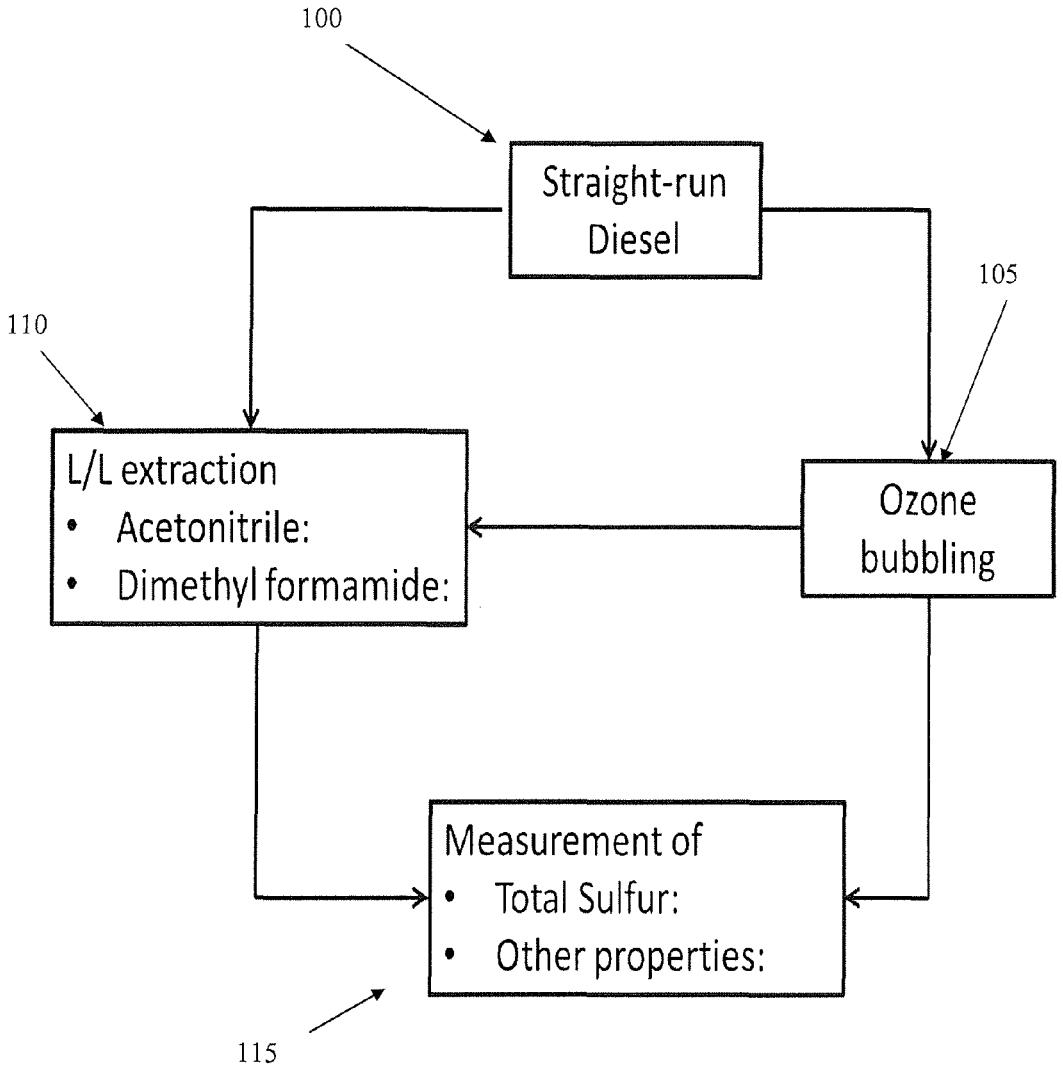
FIG. 1 shows a schematic diagram for processing steps used for straight-run diesel for desulfurization process. In which, the SRD samples were ozone bubbled and followed by extraction with different solvents to remove the oxidized sulfur. In each step the sulfur content and kinematic viscosity at 40° C. were investigated.

The present disclosure relates to a process to remove sulfur from a petroleum real product of straight-run diesel by a combination of ozone and tert-butyl hydroperoxide.

Straight-run diesel (SRD) in this invention comes from a mixture of Arabian light and Arabian heavy—65% by volume Arabian light) with sulfur content of (≅1.41 mass %) received from Saudi Arabian Oil Company (Saudi Aramco). Its Kinematic viscosity (cSt) at 40° C. is equal ~4.3. All samples were maintained under laboratory temperature (20-25° C.) prior to experimental work.

Organic compounds (analytical grade) for oxidizing, dissolving, extracting and measuring of SRD were tert-butyl hydroperoxide (t-BuOOH), acetone, acetonitrile, dimethyl formamide, hexane and toluene were purchased from Merck (Germany), Sigma-Aldrich (UK) and Alfa-Aesar, USA (Table 1).

TABLE 1

List of chemicals used in the present invention.

| No. | Chemical | Source |
|---|---|---|
| 1 | Tert-butyl hydroperoxide, 70% | Alfa-Aesar, USA |
| 2 | Acetone | Sigma-Aldrich, UK. |
| 3 | Acetonitrile (ACN) | Merck, Germany. |
| 4 | Dimethyl formamide (DMF) | Aldrich, Germany. |
| 5 | Hexane | Merck, Germany. |
| 6 | Toluene | Sigma-Aldrich, UK. |

Generation of ultra-pure ozone was produced from pure oxygen using a EXT120-T Ozone Generator (Longevity Resources Inc., Sidney, Canada). The oxygen flow rate was varied from 31-1000 cc/minute and the ozone concentration can be determined according to output setting value on ozone generator and the corresponding ozone concentration output chart (μg/ml). The SRD samples were bubbled at room temperature by ozone at different times and then extracted by various polar solvents.

The apparatus used to measure the total sulfur content is Spectroil M Oil and Fuel Analysis Spectrometer (SPECTRO$_{INC}$. QinetiQ North America, Spectroil M Model). The Spectroil M is an optical emission spectrometer that has been specifically designed for the analysis of sulfur and metals in lubricating oil, hydraulic fluids and coolants. Analysis was carried out in accordance with ASTM D-4057.

The apparatus used to measure the kinematics viscosity is Spectro-Visc Automatic Viscometer (SPECTRO$_{INC}$. QinetiQ North America, Spectro-Visc Automatic Viscometer Model). The Spectro-Visc is a bench-top semi-automatic kinematic temperature bath viscometer optimized for the analysis of used oil, new lubricants and other fluids. It conforms to the requirements in ASTM D445, D446, D7279, IP 71 and ISO 3104. It is also the ideal system for used oil analysis laboratories that need to test a wide range of lubricant viscosities. The entire cycle time from sample injection to data readout ranges from 4 to 8 minutes per tube when ASTM D445 precision is required. The Kinematics viscosity is the dynamic viscosity divided by the density.

Various processes or treatments were performed on straight-run diesel samples. Samples (about 120 ml) are exposed to ozone bubbling under normal laboratory conditions (e.g., room temperature (e.g., in the range between about 20 and 23.5° C. (68.0 and 74.3° F.) with an average of 21° C. (70° F.)) and atmospheric pressure (e.g., about 14.7 psi) at different times of exposure 15, 30, 60 and 90 minutes. Then, the ozonized SRD samples were subjected to different extraction processes to remove the oxidized polar sulfur compounds.

The use of ozone: In this method, 120 ml of SRD was bubbled with ozone under normal laboratory conditions for a period of 15, 30, 60, 90 and 120 minutes in tightly closed glass vial of 500 ml at $O_2$ flow rate of 1000 ml/minute with ozone output of 36 μg/ml (i.e. 36 μg of ozone in 1 ml of $O_2$). The ozone-containing SRD samples were then extracted with ACN and DMF by 1:2 v/v (volume of SRD/volume of solvent used) on one step and two steps. The extracted and un-extracted samples were analyzed with an optical emission spectrometer for total sulfur, and analyzed with viscosity analyzer for kinematic viscosity at 40° C. Three sets of the same extracted SRD samples were analyzed at each point.

L/L Extraction Process: The extraction of the inorganic sulfur compounds and/or other oxidized sulfur compounds (polar compounds such as thiols, sulfides and disulfides) from processed and un-processed samples was conducted to develop a technology for improved removal of total sulfur of SRD samples. In this respect, the liquid/liquid extraction was conducted using different polar solvents (i.e. dimethyl formamide, acetonitrile and methanol).

Transfer 50 ml of ozonized straight-run diesel samples to a 250 ml separator funnel and add 100 ml (dimethyl formamide or acetonitrile or methanol). Shake vigorously for 10 minutes and allow a sufficient length of time which ranged over 1 hour (SRD) for complete phase separation. In all mentioned extraction processes, drain the aqueous polar layer from the separator funnel and collect targeted non-polar layer of SRD sample for selected measurements. The second step is the same as previously described but the use of 100 ml solvent on two times of extraction. Where, 50 ml of ozonized SRD samples was added to 50 ml of solvent, extracted from the solvent and separated. Then, take the extracted volume of ozonized SRD sample and add to it an equal volume of solvent and then subject it to further extraction process.

A schematic diagram illustrates the desulfurization of straight-run diesel by ozone bubbling for a one time as shown in FIG. 1. Specifically, at step 100 straight run diesel (SRD) of sulfur content ≅1.41% mass (Weight %) is introduced into a glass vessel of ozone bubbling generator. At step 105, the SRD is subjected to a first ozone bubbling process. At step 110, an extraction process is performed using DMF, as described herein. At step 115, SRD is extracted and at step 120, total sulfur and other properties are measured, as described herein. For example, after the extraction process, the total sulfur content and kinematic viscosity at 40° C. are analyzed for the un-extracted and extracted samples.

The use of ozone bubbling twice: 120 ml of SRD was bubbled with ozone for a period of 60 minutes under normal laboratory conditions. Then, the ozonized samples were extracted with DMF by 1:2 v/v (SRD/solvent) in one step. Then, the extracted SRD samples was bubbled again with ozone for a period of 60 minutes under normal laboratory conditions and followed again by the same extraction process using DMF by 1:2 v/v.

The total sulfur content and kinematic viscosity at 40° C. were analyzed for the un-extracted and extracted SRD samples.

Figure 2:
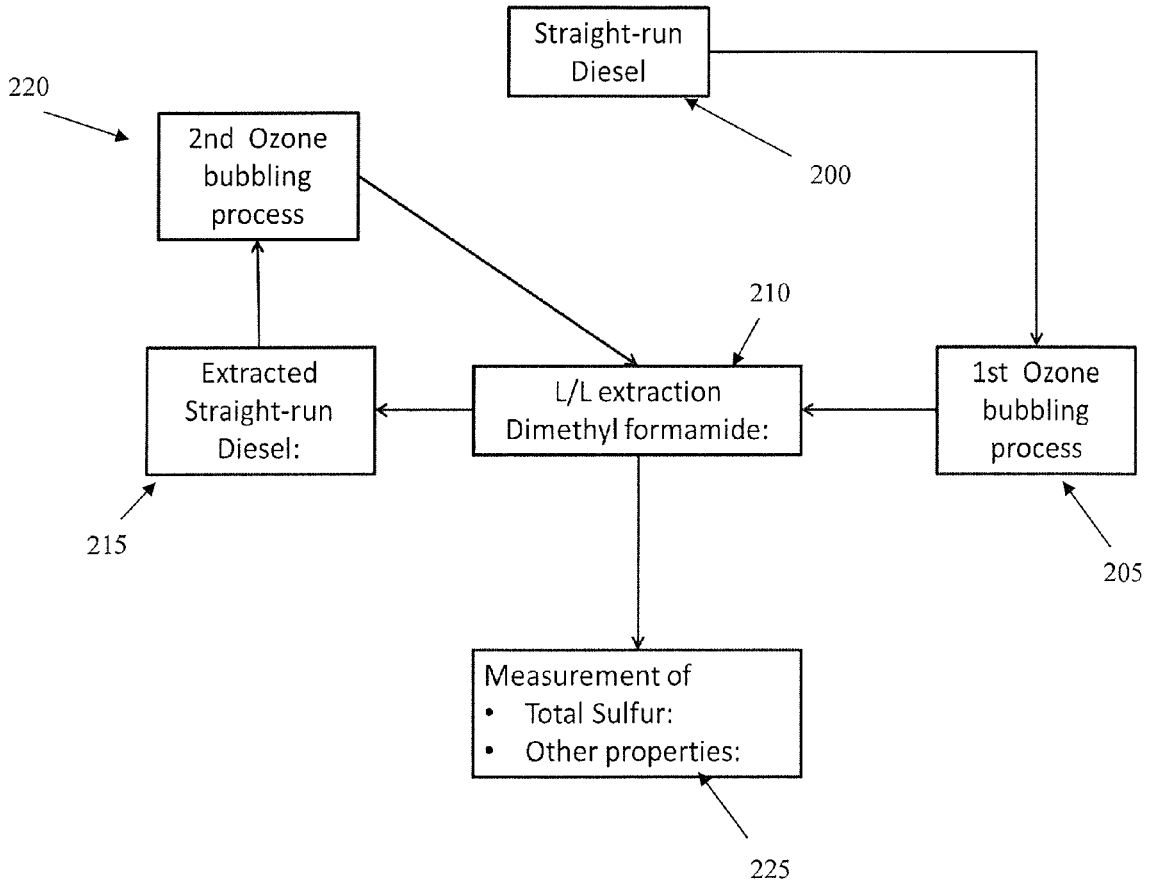
FIG. 2 shows a schematic diagram for another processing steps used for straight-run diesel for ultra-deep desulfurization process. In which, the SRD samples were subjected to ozone bubbling for two times and between each time, the ozonized samples were extracted by polar solvents and investigated for total sulfur content %.

A schematic diagram illustrates the desulfurization of straight-run diesel by ozone bubbling for two steps followed by extraction of ozone bubbled samples after each step as shown in FIG. 2. At step 200, straight run diesel (SRD of sulfur content ≅1.41% mass is introduced into a glass vessel of ozone bubbling generator. At step 205, the SRD is subjected to a first ozone bubbling process. At step 210, an extraction process is perform ed using DMF, as described herein. At step 215, SRD is extracted and at step 220, a second ozone bubbling process is performed. The process then returns to step 210. At step 225, total sulfur and other properties are measured, as described herein.

The use of t-BuOOH: t-BuOOH was selected for use as organic oxidizer for inducing oxidative desulfurization of SRD. t-BuOOH was mixed into 120 ml of SRD samples with 6.25 ml, 12.5 ml and 25 ml and stirred well magnetically at room temperature for a one hour. Then the samples were extracted with ACN and DMF by 1:1 v/v (volume of SRD/volume of solvent) one time and two times. The extracted samples were analyzed with an optical emission spectrometer for total sulfur.

The following is a description of another experiment of desulfurization of SRD by t-BuOOH. In which, 25 ml of t-BuOOH was poured into 120 ml of SRD under vigorous stirring. After that, 50 ml was extracted with 50 ml ACN or DMF for three and four times. The extracted oil samples were analyzed for total sulfur content and kinematic viscosity 40° C.

To facilitate the presentation of the processing steps applied on crude oil and straight-run diesel, each process will be conducted separately as follows:

- Ozone bubbling only.
- Ozone bubbling and extraction (ACN).
- Ozone bubbling and extraction (DMF).
- Ozone bubbling two times and extraction (DMF) for ultra-deep desulfurization.
- Measurement of total sulfur and kinematic viscosity at 40° C. of the ozonized and extracted samples.
- t-BuOOH and extraction by ACN or DMF.

The characteristics of the straight-run diesel (SRD) samples including kinematics viscosity at 40° C. and total sulfur content (%) were measured for all of the samples. In addition, sulfur removal (%) from targeted samples was determined by the difference in sulfur content in unprocessed and chemically-processed samples. The total percentage of sulfur (%) was determined at least in triplicates for each sample.

EXAMPLES

Example 1

Influence of Ozone Bubbling

The effect of ozone bubbling was investigated by bubbling ozone at room temperature in 120 ml of SRD for 15, 30, 60, 90 and 120 minutes in tightly closed glass vial of 500 ml at $O_2$ flow rate of 1000 ml/minute with ozone output of 36 μg/ml (i.e. 36 μg of ozone in 1 ml of $O_2$). The results are shown in Table 2 and FIG. 3. The results reveal that the desulfurization of SRD increases with increasing ozone bubbling time for the un-extracted samples. The total sulfur removal percentages reached values of 0, 0, 9.22, 17.0 and 28.37% with the ozone bubbling time of 0, 15, 30, 60 and 90 minutes, respectively. It is interesting to notice that when $O_3$ was introduced into the reaction, the total sulfur in the SRD phase slightly decreased without any further processes indicating slight conversion of organic sulfur compounds to $SO_x$ gases evolved into air. However, the ozone bubbling process alone is not sufficient for high sulfur removal. There are some organic non-polar sulfur compounds in straight run diesel which are converted to polar sulfur compounds by the action of ozone bubbling and have to be extracted by a polar solvent.

Figure 3:
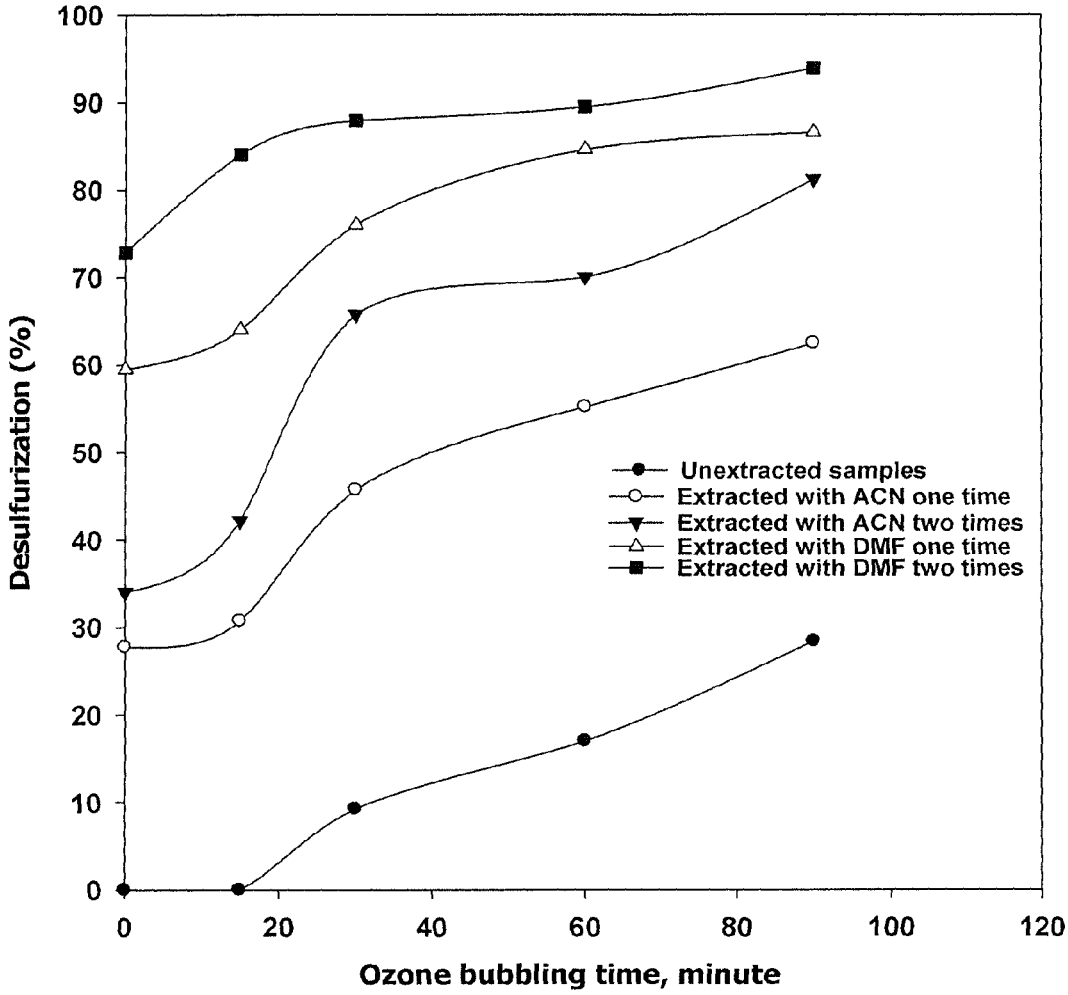
FIG. 3 shows a total sulfur content removal (%) in straight-run diesel (SRD) against ozone bubbling time for various extraction conditions.

FIG. 3 shows a total sulfur content removal (%) in straight-run diesel (SRD) against ozone bubbling time for various extraction conditions. For example, 50 of ozonized samples were extracted by 100 ml of acetonitrile (ACN) and dimethyl formamide (DMF) for one and two times. In this figure, the Y-axis is DMF in percentage and the X-axis is ozone bubbling time, in minutes. In FIG. 3, five different samples are shown: unextracted samples, extracted with ACN one time, extracted with ACN two times, extracted with DMF one time, and extracted with DMF two times.

Example 2

Influence of Ozone Bubbling and Extraction Process

When $O_3$ was bubbled into SRD and followed by extraction processes, a significant improvement was observed in the removal of total sulfur content. Ozone bubbling was performed in 120 ml of SRD for 15, 30, 60, 90 and 120 minutes in tightly closed glass vial of 500 ml at $O_2$ flow rate of 1000 ml/minute with ozone output of 36 μg/ml (i.e. 36 μg of ozone in 1 ml of $O_2$). Then the polar sulfur compounds in the ozonized SRD samples were extracted using acetonitrile and DMF (see the results in Table 2 and FIG. 3). In case of extraction using ACN by 1:2 v/v (volume of SRD/volume of solvent) in one time, the total sulfur removal was reported as 20.0, 30.7, 45.7, 55.18 and 62.43%; (extraction with the same ratio for two times) the removal was 30, 42.18, 65.7, 63.3, 81.16% under bubbling of ozone for a time of 0, 15, 30, 60 and 90 minutes, respectively. Moreover, in case of extraction using DMF with the same ratio one time the removal of total sulfur was 51.1, 64, 76.02, 84.62, and 86.56%; (two times) the removal was 60.2, 84.04, 87.9, 90.0 and 94.0% under bubbling of ozone for a time of 0, 15, 30, 60, and 90 minutes, respectively. It was found that DMF has better extractability of sulfur compounds from SRD than ACN. The maximum desulfurization reached 93.86% and 81.16% in case of use of extraction of sulfur compounds by DMF and ACN, respectively for ozone bubbling time of 90 minutes. Although, the extractability of DMF for S-compounds is higher than ACN, the DMF is not easily separated from the oil samples containing S-compounds as ACN. This can be related to the boiling point of DMF (b.p. 153° C.) is higher than boiling point of ACN (b.p. 82° C.). From previous results, it is observed that 60 and 90 minutes of bubbling with DMF showed slightly higher efficiency for sulfur removal process compared with ACN. Additionally, the results of sulfur removal at 90 minutes are slightly higher than of 60 minutes, so the selection of 60 or 90 minutes depends on the economical evaluation of the process. Table 3 shows the kinematic viscosity at 40° C. of the un-extracted and extracted SRD samples. It was found that the kinematic viscosity was not influenced significantly by ozone bubbling followed by extraction process, which proved the validity of the process for sulfur removal.

Example 3

Use of Ozone Bubbling Two Times Followed by Extraction Two Times for Ultra-Desulfurization Process Ozone bubbling into SRD two times produced an ultra-desulfurized SRD where the desulfurization reached 98%. In the following experiment, 120 ml of SRD was bubbled with ozone for 60 minutes. Then, the ozonized samples were extracted with DMF by 1:2 v/v (SRD/solvent) two times. The sulfur removal was equal to 87% (Sulfur content is about 2229 ppm). After that, the extracted samples were bubbled again with ozone for 60 minutes and extracted again with DMF by 1:2 v/v. The sulfur removal was 98%.

TABLE 2

Ozone-induced desulfurization (%) of SRD for various durations of ozone bubbling at different extraction conditions with ACN and DMF.

| | Desulfurization, % before and after extraction | | | | |
|---|---|---|---|---|---|
| Ozone bubbling time (min) | Before extraction | 50 ml SRD with 100 ml ACN | 50 ml SRD with 100 ml ACN twice | 50 ml SRD with 100 ml DMF | 50 ml with 100 ml DMF twice |
| 0 | 0 | 20 | 30.0 | 51.1 | 60.2 |
| 15 | 0 | 30.7 | 42.18 | 64 | 84.04 |
| 30 | 9.22 | 45.7 | 65.7 | 76.02 | 87.9 |
| 60 | 17.0 | 55.18 | 63.3 | 84.6 | 90.0 |
| 90 | 28.37 | 62.43 | 81.16 | 86.56 | 94.0 |

TABLE 3

Kinematic viscosity (cSt) at 40° C. SRD under ozone bubbling for various durations for the un-extracted and extracted crude oil with acetonitrile.

| | Kinematic viscosity (cSt) at 40° C. of SRD before and after extraction | | | | |
|---|---|---|---|---|---|
| Ozone bubbling time (min) | Before extraction | 50 ml SRD with 100 ml ACN | 50 ml SRD with 100 ml ACN twice | 50 ml SRD with 100 ml DMF | 50 ml with 100 ml DMF twice |
| 0 | 4.37 | 4.20 | 4.12 | 3.99 | 4.32 |
| 15 | 4.56 | 3.95 | 4.0 | 4.08 | 4.11 |
| 30 | 4.49 | 3.97 | 4.16 | 4.31 | 3.74 |
| 60 | 4.56 | 3.95 | 3.95 | 4.08 | 4.11 |
| 90 | 4.64 | 4.39 | 4.14 | 4.03 | 4.01 |

Figure 4:
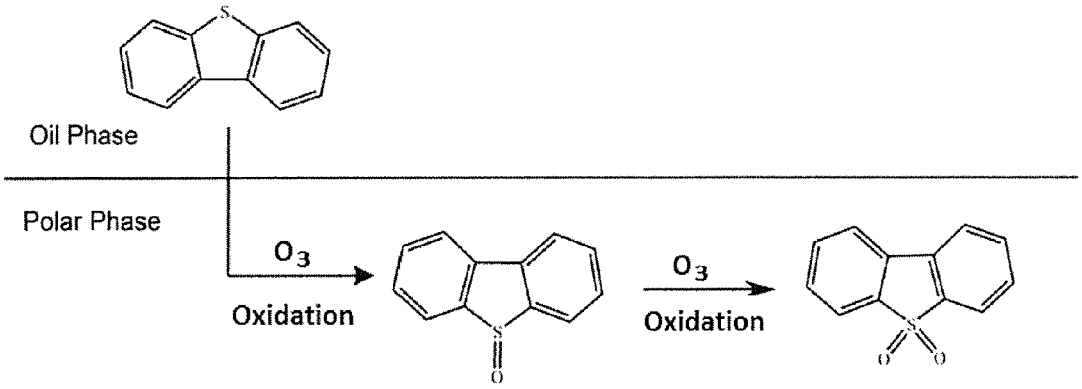
FIG. 4 shows a process of oxidation-extraction of dibenzothiophene in straight-run diesel by ozone.

Sulfur-containing compounds are oxidized using a selective ozone, etc. and such oxidant can donate oxygen atoms to the sulfur in mercaptans (thiols), sulfides, disulfides and thiophenes to form sulfoxides or sulfones (see FIG. 4).

Figure 5:
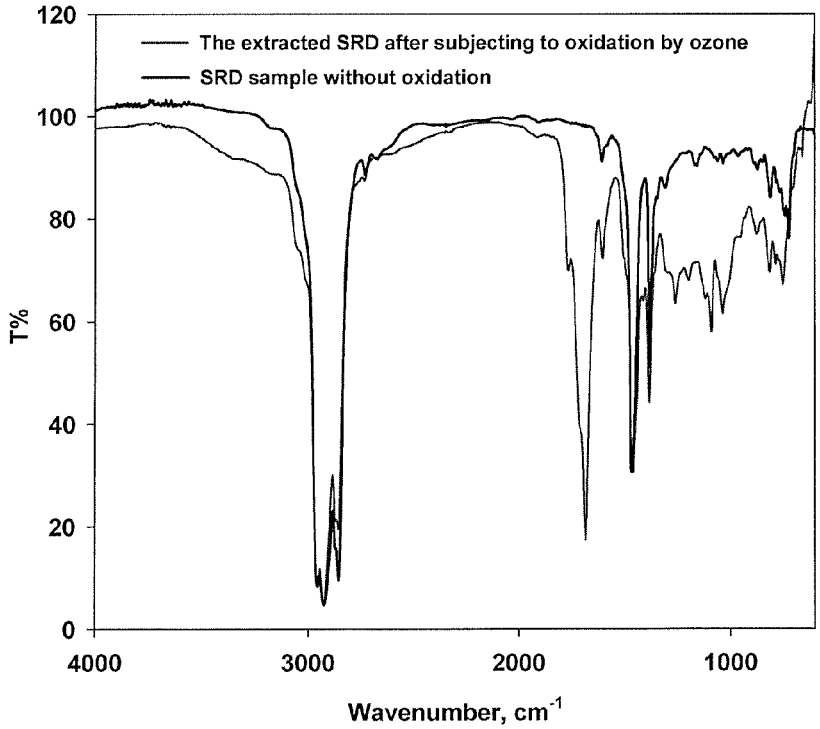
FIG. 5 shows FTIR spectra of non-ozonized and ozonized straight-run diesel samples.

FTIR spectra of SRD before and after subjecting to ozone bubbling were characterized by the absorption bands over 2960-2850 $cm^{-1}$ and two absorption bands at 1459 and 1377 $cm^{-1}$, all are associated with $CH_2$ and $CH_3$ of aliphatic hydrocarbons (see FIG. 5). It's clear that, the spectrum of oxidized SRD sample has specific absorption at 1350-1300 $cm^{-1}$ and 1135-1170 $cm^{-1}$ which assigned for oxidized sulfur compounds (sulfoxides and sulfones S═O). The spectra showed strong absorption bands in the range of 1800-1640 $cm^{-1}$ indicate the presence of carbonyl groups (C═O) which probably is due to oxidation of aliphatic hydrocarbons in SRD sample.

Example 4

Use of t-BuOOH Followed by Extraction with ACN for Removal of Sulfur Compounds from SRD In this experiment, t-BuOOH was selected for use as organic oxidizer for inducing oxidative desulfurization of SRD. TBHO was introduced into 120 ml of SRD samples with different volumes (6.25 ml, 12.5 ml and 25 ml) and stirred well magnetically at room temperature for a one hour period. Then, the samples were extracted with acetonitrile ACN by 1:1 v/v (volume of SRD/volume of solvent) for one, two and three times. The extracted samples were analyzed for total sulfur and kinematic viscosity at 40° C. Table 4 shows the desulfurization of SRD at room temperature under different t-BuOOH concentrations. It is found that the desulfurization increases with the increase of t-BuOOH concentration from 6.25 ml to 12.5 ml then the desulfurization tends to saturate at higher concentrations. The maximum desulfurization was reported as 66.05%.

Table 5 shows the kinematic viscosity (cSt) at 40° C. for all previous stated conditions. The results indicated that there are little differences in the kinematic viscosity under these stated conditions and the kinematic viscosity was not influenced markedly by the action of t-BuOOH.

Example 5

Influence of Use of t-BuOOH Followed by Extraction with ACN and DMF on Oxidative Desulfurization of SRD In this experiment, 120 ml of SRD was included in 500 ml glass vessels and 25 ml of t-BuOOH was added to this sample.

This mixture was stirred magnetically for a one hour. After that, 50 ml from the samples was extracted with 50 ml ACN three and four times, and then the extracted oil samples were analyzed for total sulfur in the samples. The results revealed that the extraction of the samples with ACN three and four times induced reduction of total sulfur with 60.05% and 71.64%, respectively. Another 50 ml of SRD reacted with t-BuOOH was extracted with 50 ml DMF three and four times. The results revealed that the extraction process with DMF three and four times produced sulfur removal of 90.5% and 92.5%, respectively.

TABLE 4

Oxidative desulfurization of SRD at various t-BuOOH concentrations after extraction with ACN.

| Volume of t-BuOOH (ml) in 120 ml of SRD | Desulfurization, % after extraction with ACN | | | |
|---|---|---|---|---|
| | (SRD/ACN, 1/2 v/v), one time | (SRD/ACN, 1/1 v/v), two times | (SRD/ACN, 1/1 v/v), three times | (SRD/ACN, 1/1 v/v), four times |
| 6.25 | 37.07 | 43.46 | 49.45 | 52.03 |
| 12.5 | 48.80 | 50.33 | 55.88 | 64.03 |
| 25 | 40.67 | 45.7 | 57.25 | 66.05 |

TABLE 5

Kinematic viscosity (cSt) at 40° C. of SRD in the presence of various t-BuOOH concentrations.

| Volume of t-BuOOH (ml) in 120 ml of SRD | Kinematic viscosity (cSt) at 40° C. of SRD after extraction | | | |
|---|---|---|---|---|
| | (SRD/ACN, 1/2 v/v), one time | (SRD/ACN, 1/1 v/v), two times | (SRD/ACN, 1/1 v/v), three times | (SRD/ACN, 1/1 v/v), four times |
| 6.25 | 4.11 | 4.33 | 4.26 | 4.51 |
| 12.5 | 4.06 | 4.2 | 4.51 | 4.44 |
| 25 | 3.93 | 4.25 | 4.33 | 4.28 |

The foregoing examples have been provided for the purpose of explanation and should not be construed as limiting the present invention. While the present invention has been described with reference to an exemplary embodiment, Changes may be made, within the purview of the appended claims, without departing from the scope and spirit of the present invention in its aspects. Also, although the present invention has been described herein with reference to particular materials and embodiments, the present invention is not intended to be limited to the particulars disclosed herein; rather, the present invention extends to all functionally equivalent structures, methods and uses, such as are within the scope of the appended claims.

What is claimed is:

1. A process for desulfurization of straight-run diesel (SRD), comprising: bubbling ozone into SRD, the SRD having a sulfur content of ◎ 1.41 mass % before desulfurization; and measuring levels of total sulfur and kinematic viscosity for the ozone bubbled SRD, wherein the bubbling of the ozone is performed at a rate of 36,000 μg/min.

2. The process of claim 1, wherein ozone is bubbled into the SRD at room temperature and atmospheric pressure.

3. The process of claim 1, wherein a time of the bubbling is one of 0, 15, 30, 60, and 90 minutes.

4. The process of claim 3, further comprising decreasing a total sulfur content in the SRD by the ozone bubbling at 30 minutes.

5. The process of claim 3, further comprising decreasing a total sulfur content in the SRD by the ozone bubbling at 60 minutes.

6. The process of claim 3, further comprising decreasing a total sulfur content in the SRD by the ozone bubbling at 90 minutes.

7. The process of claim 1, wherein total sulfur content % is measured by fuel spectrometer and kinematic viscosity is measured at 40° C. by a viscosity analyzer.

8. The process of claim 1, further comprising forming $SO_x$ gases in the SRD after exposure to the ozone.

9. A process for desulfurization of straight-run diesel (SRD), comprising:

bubbling ozone into SRD;

extracting the bubbled SRD using two different solvents in two different operations, and the SRD having a sulfur content of ◎ 1.41 mass %; and then measuring levels of total sulfur and kinematic viscosity for the extracted SRD, wherein a first solvent used for the extracting consists of acetonitrile (ACN) and a second solvent used for the extracting consists of dimethyl formamide (DMF).

10. The method of claim 9, wherein the bubbling of the ozone is performed at a rate of 36,000 μg/min.

11. The process of claim 9, wherein ozone is bubbled into the straight-run diesel at room temperature and atmospheric pressure.

12. The process of claim 9, wherein a first time of bubbling is one of 0, 15, 30, 60, and 90 minutes.

13. The process of claim 9, wherein the extracting includes use of acetonitrile as 1:2 v/v (volume of SRD/volume of ACN) for extraction in one operation.

14. The process of claim 9, wherein the extracting includes use of DMF as 1:2 v/v (volume of SRD/volume of DMF) for extraction in one operation.

15. The process of claim 9, wherein the extracting includes use of ACN as 1:2 v/v (volume of SRD/volume of ACN) by extraction in two operations comprising 50 ml of ozonized SRD extracted by 50 ml of the ACN, and then the extracted SRD is extracted again by 50 ml of the ACN.

16. The process of claim 9, wherein the extracting includes use of DMF as 1:2 v/v (volume of SRD/volume of DMF) by extraction in two operations, comprising 50 ml of ozonized SRD extracted by 50 ml of the DMF, and then the extracted SRD is extracted again by 50 ml of the DMF.

17. The process of claim 16, wherein the extracted SRD is analyzed for total sulfur content % by a fuel spectrometer and for kinematic viscosity at 40° C. by a viscosity analyzer.

18. A process, comprising:

desulfurization of straight-run diesel (SRD) by alternating ozone bubbling and extraction process, each extraction using dimethyl formamide (DMF); and measuring levels of total sulfur after each extraction process.

19. The method of claim 18, wherein each bubbling of the ozone is performed at a rate of 36,000 μg/min.

20. The process of claim 19, wherein the ozone bubbling process is under room temperature and atmospheric pressure.

21. The process of claim 18, wherein a first operation of ozone bubbling is for a period of 60 minutes.

22. The process of claim 21, wherein the process of extraction after the first time of ozone bubbling includes uses the DMF as 1:2 v/v (volume of SRD/volume of DMF) by extraction in one operation, comprising 50 ml of ozonized SRD extracted by 100 ml of the DMF.

23. The process of claim 22, wherein the extracted SRD is analyzed for total sulfur content %.

24. The process of claim 21, wherein a second operation of ozone bubbling is for a period of 60 minutes.

25. The process of claim 24, wherein:

the process of extraction after a first operation of ozone bubbling includes using the DMF as 1:2 v/v (volume of SRD/volume of DMF) by extraction in one operation, comprising 50 ml of ozonized SRD extracted by 100 ml of the DMF; and a second operation of ozone bubbling is performed on the extracted SRD for a period of 60 minutes.

26. The process of claim 24, wherein the ozonized SRD is extracted by the DMF.

27. The process of claim 26, wherein the process of extraction includes DMF as 1:2 v/v (volume of SRD/volume of DMF) in one operation, comprising 50 ml of ozonized SRD extracted by 100 ml of DMF.

28. The process of claim 27, wherein the extracted SRD is analyzed for total sulfur content.

29. A process for desulfurizing of straight-run diesel (SRD) by t-BuOH comprising:

adding t-BuOOH to SRD under vigorous stirring, the SRD having a sulfur content of ≅1.41 mass % before desulfurization;

extracting oxidized sulfur compounds;

bubbling ozone into the SRD; and measuring levels of total sulfur of the desulfurized SRD.

30. The process of claim 29, wherein the t-BuOOH used for oxidizing sulfur compounds is a 70% aqueous solution by volume.

31. The process of claim 29, wherein the t-BUOOH is introduced into the SRD at room temperature and atmospheric pressure.

32. The process of claim 29, wherein the t-BUOOH used for oxidation processes is introduced at one of 6.25, 12, and 25 ml into 120 ml of the SRD.

33. The process of claim 29, further comprising forming oxidized products in the SRD after reacting with the t-BUOOH.

34. The process of claim 29, wherein a solvent used for extraction process is acetonitrile (ACN).

35. The process of claim 29, wherein the process of extraction in one operation includes use of ACN as 1:2 v/v (volume of SRD/volume of ACN), comprising 50 ml of oxidized SRD by the t-BUOOH extracted by 100 ml of ACN.

36. The process of claim 29, wherein the process of extraction in two, three and four operations includes the use of ACN as 1:1 v/v (volume of SRD/volume of ACN), comprising 50 ml of oxidized SRD by the t-BUOOH extracted by 50 ml of ACN in each of two, three, and four operations.

37. The processes of claim 36, wherein the extracted SRD is analyzed for detecting sulfur removal content % and kinematic viscosity at 40° C.

38. A process for desulfurizing of straight-run diesel (SRD) by t-BuOH comprising:

adding t-BuOH to SRD to oxidize compounds of the SRD;

extracting the oxidized compounds with acetonitrile (ACN) and dimethyl formamide (DMF);

bubbling ozone into the SRD; and measuring of total sulfur content % of the desulfurized SRD.

39. The process of claim 38, wherein the t-BuOOH used for oxidizing sulfur compounds is a 70% aqueous solution by volume.

40. The process of claim 38, wherein the t-BUOOH is introduced into the SRD samples at room temperature and atmospheric pressure.

41. The process of claim 38, wherein the t-BUOOH used for oxidation processes is introduced at 25 ml into 120 ml of the SRD.

42. The process of claim 38, further comprising forming oxidized products in the SRD after reacting with the t-BUOOH.

43. The process of claim 38, wherein solvents used for extraction process are the ACN and the DMF.

44. The process of claim 38, wherein the process of extraction in three and four operations includes the use of the ACN as 1:1 v/v (volume of SRD/volume of ACN), comprising 50 ml of oxidized SRD by the t-BUOOH extracted by 50 ml of the ACN in each of three and four operations.

45. The process of claim 38, wherein the process of extraction in three and four operations includes the use of the DMF at 1:1 v/v (volume of SRD/volume of DMF), comprising 50 ml of oxidized SRD by the t-BUOOH extracted by 50 ml of the DMF in each of three and four operations.

46. The processes of claim 45, wherein the extracted SRD is analyzed for detecting sulfur removal in %.

* * * * *